US005290425A

United States Patent [19]

Momotani et al.

[11] Patent Number: 5,290,425

[45] Date of Patent: Mar. 1, 1994

[54] ORGANIC SOLVENT ELECTROLYTE FOR PLATING FILM OF $R_2T_{14}B$ INTERMETALLIC COMPOUND PERMANENT MAGNET

[75] Inventors: Hiroshi Momotani; Tsutomu Otsuka, both of Miyagi, Japan

[73] Assignee: Tokin Corporation, Miyagi, Japan

[21] Appl. No.: 873,243

[22] Filed: Apr. 24, 1992

[51] Int. Cl.[5] ..... C25D 3/00

[52] U.S. Cl. ..... 205/234

[58] Field of Search ..... 205/234

[56] References Cited

U.S. PATENT DOCUMENTS 4,925,536 5/1990 Lehmkuhl ..... 205/234

*Primary Examiner*—T. M. Tufariello

*Attorney, Agent, or Firm*—Hopgood, Calimafde, Kalil, Blaustein & Judlowe

[57] ABSTRACT

An organic solvent electrolyte is provided for electrolytically forming a plating film on the surface of a $R_2T_{14}B$ intermetallic compound permanent magnet. The organic solvent electrolyte comprises a metallic salt including at least one metalic element with a supporting electrolyte, the balance being an organic solvent for forming a plating film on the surface of a $R_2T_{14}B$ intermetallic compound permanent magnet, wherein R denotes a rare earth element including Y and T denotes a transition metal including R, Fe and B as main components. The supporting electrolyte includes at least one selected from a group consisting of:

(1) a boric acid compound including at least one of $R'_3BO_3$ methyl, ethyl, propyl, butyl group, $MBO_2$ (in which M denotes H or Na, K, Li metal), $M'BO_3$ (M' denotes B or Na, K, Li metal), $M'''BO_xO_{(3x+2)/2}$ (X is an even number of more than 2).

(2) a $C10_4$ salt of an alkali metal or tetraalkylammonium including at least one of $M'C10_4$ or $R'_4NC10_4$, and (3) a $BF_4$ salt of an alkali metal or tetraalkylammonium including at least one of $M'BF_4$ or $R'NBF_4$.

29 Claims, 2 Drawing Sheets (RESULT OF SIMS ANALYSIS OF AN ORGANIC ELECTROLYTE PLATING LAYER BY Ni SALT-$Na_2B_4O_7$-METHANOL)

(RESULT OF SIMS ANALYSIS OF AN ORGANIC ELECTROLYTE PLATING LAYER BY Ni SALT-$Na_2B_4O_7$-METHANOL)

(RESULT OF SIMS ANALYSIS OF A PLATING LAYER BY WATTS BATH)

ORGANIC SOLVENT ELECTROLYTE FOR PLATING FILM OF $R_2T_{14}B$ INTERMETALLIC COMPOUND PERMANENT MAGNET

TECHNICAL FIELD

The present invention relates to an improvement of the oxidation resistance of a $R_2T_{14}B$ intermetallic compound permanent magnet (herein, R denotes a rare earth element including Y and T denotes a transition metal) plated with a film according to an organic electrolyte plating method and especially to an organic solvent electrolyte for forming a plating film on the surface of a $R_2T_{14}B$ intermetallic compound permanent magnet.

BACKGROUND ART

A $R_2T_{14}B$ rare earth permanent magnet represented by a Nd-Fe-B magnet is generally known to have superior magnetic properties to a Sm-Co rare earth permanent magnet. Moreover, consisting of Nd and Fe which are rich natural resources, the former magnet is provided at a lower price than the latter and is being used widely.

On the contrary, however, the R-Fe-B rare earth permanent magnet has a special internal oxidation factor that it includes in its metallic organization of an alloy a R-Fe solid solution which is oxidized extremely easily in the atmosphere. The R-Fe-B rare earth permanent magnet had, therefore, problems that an oxide layer formed at the surface of the magnet by precipitation brought about deterioration and irregularity in the magnetic properties and that being used as such an electric part as a magnetic circuit, the dispersion of the oxide film contaminated the peripheral devices.

To remove the problems, a method has been applied in the prior art for forming an oxidation resistant film such as a plating film or a chemically formed film at the surface of the magnet using a water solution as a plating solution which is disclosed in Japanese patent prepublications Tokkai Sho 60-54406 or Tokkai Sho 60-63903.

The prior method for forming an oxidation resistant film such as a plating film or a chemically formed film described above has, however, a defect that the R-Fe solid solution was rapidly oxidized in the plating process because the method has an outer oxidation factor that large quantity of water or water solution is used as a plating liquid for plating process. As a result, a problem arose that the effect of preparation process which is important in the plating process was lost thereby preventing generation and growth of the plating film at the surface of the magnet bringing about poor adhesion and powder precipitates.

Further, even though the oxidation resistant film such as a plating film or a chemically formed film was provided, oxidation proceeded internally by an oxide layer or absorbed water remaining between the surface of the magnet and the plating film thereby leaving a cause of the poor adhesion such as swell or exfoliation of the film.

Further, in the surface treatment according to the PVD method such as an ion-plating, the film formed was a pastic precipitate lacking fineness.

It has been, therefore, difficult to improve the oxidation resistance by the prior surface treatments.

On the other hand, a method has been known for coating the surface of the rare earth permanent magnet by using an organic electrolyte plating method in which a nonwater organic solvent is used as an electrolyte (a tetrahydrofuran cell etc.). The organic solvent, even if it is a nonwater plating liquid, has, however, a defect which is peculiar to the organic solvent that it deteriorated even its dielectric constant since the organic solvent itself is a polar solvent which easily absorbs water and has small solubility of salts.

Further, to remove the defects described a prior ordinary supporting electrolyte could not cope with the internal oxidation factor which is peculiar to the $R_2T_{14}B$ rare earth permanent magnet material having the R-Fe solid solution extremely easy to be oxidized and thereby obtaining a plating film having no brilliance and poor adhesion.

It is, therefore, a first object of the present invention to provide an organic solvent electrolyte for forming on the surface of a $R_2T_{14}B$ intermetallic compound permanent magnet an oxidation resistant film having an improved brilliance (an appearance) and adhesion by using an organic electrolysis method necessitating no large quantity of water or water solution in a plating process.

Further, it is a second object of the present invention to provide an organic solvent electrolyte for a plating film which uses a supporting electrolyte for wide use which is applicable to various kinds of organic solvents in accordance with the internal oxidation factor which is peculiar to the $R_2T_{14}B$ rare earth permanent magnet.

Further, it is a third object of the present invention to provide an organic solvent electrolyte for a plating film which improves the solubility into the organic solvent and the conductivity of the supporting electrolyte according to the present invention.

Further, it is a fourth object of the present invention to provide an organic solvent electrolyte for a plating film which removes the outer oxidation factor in the plating process.

DISCLOSURE OF THE INVENTION

According to the present invention, an organic solvent electrolyte for forming a plating film on the surface of a $R_2T_{14}B$ intermetallic compound permanent magnet is provided which is used in a plating process based on a plating method using organic solvent electrolyte comprising a metallic salt including at least one metallic element, a supporting electrolyte and the balance of an organic solvent for forming a plating film on the surface of a $R_2T_{14}B$ intermetallic compound permanent magnet (herein, R denotes a rare earth element including Y and T denotes a transition metal) including R, Fe and B as main components, characterized in that the supporting electrolyte includes at least one selected from a group consisting of:

(1) a boric acid compound including at least one of $R'_3BO_3$ (R' denotes H or alkyl group), $MBO_2$ (M denotes H or alkaline metal), $M'BO_3$ (M' denotes an alkali metal), $M'_2B_xO_{(3x+2)/2}$ (x is an even number of more than 2), (2) a $XO_4^-$ salt of an alkali metal or tetraalkylammonium including at least one of $M'XO_4$ or $R'_4NXO_4$ (X denotes a halogen), (3) a $BX_4^-$ salt of an alkali metal or tetraalkylammonium including at least one of $M'BX_4$ or $R'NBX_4$, (4) a $PX_6^-$ salt of an alkali metal or tetraalkylammonium including at least one of $M'PX_6$ or, $R'NPX_6$, (5) a $CX_3SO_3^-$ salt of an alkali metal or tetraalkylammonium including at least one of $M'CX_3SO_3$ or $R'_4NCX_3SO_3$, (6) a $R'COO^-$ salt of an alkali metal including R'COOM.

According to the present invention, an organic solvent electrolyte for plating a $R_2T_{14}B$ intermetallic compound permanent magnet is provided which is characterized in that the tetraalkylammonium $XO_4^-$ salt is a perchloric acid tetrabutyrammonium $[[CH_3(CH_2)_3]_4NC10_4]$.

According to the present invention, an organic solvent electrolyte for plating a $R_2T_{14}B$ intermetallic compound permanent magnet is provided which is characterized in that the organic solvent electrolyte includes dycyclic crown compound added with the supporting electrolyte thereby forming anionic complex therein to activate metallic cation.

According to the present invention, an organic solvent electrolyte for plating is provided which is used in a plating process based on a plating method using organic solvent electrolyte comprising a metallic salt including at least one metallic element, a supporting electrolyte and the balance of an organic solvent for forming a plating film on the surface of a $R_2T_{14}B$ intermetallic compound permanent magnet (herein, R denotes a rare earth element including Y and T denotes a transition metal) including R, Fe and B as main components, characterized in that the supporting electrolyte includes at least one of a trifluoroacetate, an acetic acid and a perchlorate as the metallic salt and at least one element of Al, Pb, Sn, Cr, Ni, Cu and Zn as the acids.

According to the present invention, an organic solvent electrolyte for plating is provided which is used in a plating process based on a plating method using organic solvent electrolyte comprising a metallic salt including at least one metallic element, a supporting electrolyte and the balance of an organic solvent for forming a plating film on the surface of a $R_2T_{14}B$ intermetallic compound permanent magnet (herein, R denotes a rare earth element including Y and T denotes a transition metal) including R, Fe and B as main components, characterized in that the organic solvent includes at least one of a protic amthoteric solvent and a protophilic solvent.

According to the present invention, an organic solvent electrolyte for plating a $R_2T_{14}B$ intermetallic compound permanent magnet is provided in which it is characterized in that the protic amthoteric solvent in the organic solvent electrolyte includes at least one of methanol ($CHO_3H$) and ethanol ($C_2H_5OH$)and the protophilic solvent includes at least one of a holmamide ($HCONH_2$), dimethylholmamide $[HCON(CH_3)_2]$ and acetamide ($CH_3CONH_2$)

According to the present invention, an organic solvent electrolyte for plating a $R_2T_{14}B$ intermetallic compound permanent magnet is provided in which it is characterized in that either one of the organic solvent electrolyte includes at least one of a hypophosphite $MH_2PO_2$ and sulfamic acid ($C_7H_5NO_3S$) as a stabilizer added with the supporting electrolyte.

According to the present invention, an organic solvent electrolyte for plating a $R_2T_{14}B$ intermetallic compound permanent magnet is provided which is characterized in that either one of the organic solvent electrolyte substantially includes the metallic salt of 0.1-2.0 mol/l, the supporting electrolyte and the stabilizer of at least 0.005 mol/l and the balance of the solvent.

According to the present invention, an organic solvent electrolyte for plating a $R_2T_{14}B$ intermetallic compound permanent magnet is provided which is characterized in that either one of the organic solvent electrolyte includes water of substantially less than 3000 ppm.

Accordingly, the organic plating electrolyte of the present invention is an organic solution into which a metallic salt and a supporting electrolyte are dissolved used as an electrolyte in a plating method.

The supporting electrolyte of the present invention (the first and the second claims)

Although it is known that the supporting electrolyte is decomposed into ions in a solution ($E_xNH_4CL \rightarrow NH_4^+ +$, $Co^-$) and thereby making the solution electrically conductive, it is found by the inventors of the present invention that some appropriate selection of characteristics of the supporting electrolyte not only improve the conductivity of the $R_2T_{14}B$ rare earth permanent magnet material but also causes a great influence to properties (adhesion or brilliance) of the plating film, to the shape of crystalline particles and to the oxidation resistance, the finding thus resulting in the present invention.

After having done various experiments, inventors have obtained a supporting electrolyte which matches with the properties of the $R_2T_{14}B$ rare earth permanent magnet material and improves not only the conductivity of the plating eletrolyte but also the oxidation resistance, adhesion and the appearance (the brilliance) of the plating film as described in Claim 1.

If the supporting electrolyte is represented in the form of $X^+Y^-$, $X^+$ and $Y^-$ ions are respectively represented as follows:

$X^+$: $H^+$, $M^+$ (an alkali metal), $NR^{+4}$ (R: H or an alkyl group);

$Y^-$: boric acid series negative ions, $XO_4^-$, $BX_4^-$, $PX_6^-$, $CX_3SO_3^-$, $RCOO^-$, $NO_3^-$, $SO_4^{2-}$, etc. (X: a halogen, R'H or an alkyl group). However, the combination of the both ions $X^+$ and $Y^-$ is a key to which matches with the properties of the $R_2T_{14}B$ rare earth permanent magnet material.

More specifically, with such generally known combinations as $X^+$ of $H^+$, $M^+$ or even a cation of $NR_4'$ and $Y^-$ of $NO_3^-$ or $SO_4^{2-}$, it is difficult to obtain $R_2T_{14}B$ rare earth permanent magnet materials with brilliance, good adhesion between the plating film and the $R_2T_{14}B$ rare earth permanent magnet materials and the good oxidation resistance. The reason is that discharge reaction of the anion $Y^-$ takes place at the surface of the electrode and the resultant compounds together with the anion $Y^-$ enhance the oxidation ability of the electrolyte solution thereby affecting the surface of the $R_2T_{14}B$ rare earth permanent magnet materials. As a result, deterioration occurs in adhesion of the plating film or in some other properties of the $R_2T_{14}B$ rare earth permanent magnet.

Using the supporting electrolyte according to the present invention, it is possible to plate such various metals as Ni, Cr, Cu, Sn, Co as in case of plating using a normal water solution electrolyte and it is possible to select many other metals for plating. With regard to organic solvents to be used, it is also possible to use many various organic solvents such as alcohol including ethanol, methanol, aromatic compounds including a benzen, amide group, BP, hexane, xylene of other solvents. It is desirable, however, to select those solvents which have a high dielectric constant, low viscosity and which have low vapor pressure, dangerness and poisonousness for preventing the air pollution etc.

Although the supporting electrolyte is different from that of used in electrolytic plating using normal water solution, it is very advantageous in industry because the plating method is relatively simple and the manufacturing cost is lower than the conventional dry type plating methods such as plastic coating or sputtering.

A dycycle crown compound (Claim 3)

A description is made about the dycycle crown compound which improves a solubility of an organic solvent for plating metals and a conductivity of the supporting electrolyte by using with the supporting electrolyte according to the present invention mentioned above.

Generally, it is inevitable that an organic solvent has a smaller solubility for salts than water solvents and thus a reaction rate and a conductivity must be decreased. For solving the problem, the inventors of the present invention investigated various compounds which can form complexes with electrolytically dissociated ions, increase the solubility into the organic solvents and cooperate with the supporting electrolyte according to the present invention. As a result, they found the dycycle crown compound to meet the objects of the present invention since it is able to include an anion.

A klyptand is found to be effective since it is supposed that the compound is soluble into the organic solvents by including the anion and that it seems as if only cations exist in the solution by including the anion although an electrolyte usually exists in a solution as ion pairs resulting in an electrically neutral solution as a whole.

Metallic salts according to the present invention (Claim 4)

According to the present invention, various metallic salts can be used as soludes. It is also an advantage of the present invention that aluminum salts or titanium salts can be used which are usually difficult to be electrolytically separated from a water solution since the electrolyte of the present invention has a wide voltage range for stable use and there is no concurrent occurrence at the time of metal electrolytic separation using a solvent having no active hydrogen. Specifically, a triethylaluminum ($Al(C_2H_5)_3)_2$, trifluoroaceticnickel ($Ni(CF_3COO)_2$), trifluoroaceticcupper ($Cu(CF_3COO)_2$) and An organic solvent according to the present invention (Claims 5 and 6)

An organic solvent is explained at first in a method for removing an outer oxidation factor in the organic electrolyte plating process. Rare earth metal (R) compounds are generally mainly composed of ionic compounds of 3 valents. The metals are highly reactive and gradually react with cold water as follows:

$$R+3H_2O-R+(OH)_3+3/2H2$$

It is readily anticipated that the resultant hydroxide will be an oxide as the reaction proceeds. It will be thus understood from the fact that a contact to water should be avoided as completely as possible when the $R_2T_{14}B$ alloy are coated with an oxidation resistant film. An organic solvent is, therefore, used as a replace of water solvent.

Although various kinds of organic solvents can be used as the solvents used for the present invention, it is desirable to select the solvents for the organic electrolyte plating cell which generally have the following properties:

1) Those which are less poisonous or dangerous.
2) Those which have a low viscosity and a good conductivity.
3) Those which have a high dielectric constant and make it easier for soludes to be solved and separated.

Further the metals which can be used for plating according to the present invention using the organic electrolyte plating method are Ni, Cr, Cu, Co as in the electrolytic plating using ordinary water solution and many other selections can be made in accordance with the purposes of use.

Further, various kinds of organic solvents such as an alcohol, an aromatic compound, an amide, a hexane, a xylene can be used. It is desired to use those organic solvents which has a high dielectric constant, low viscosity and low water content. With regard to the water content, organic solvents can be used after removing the water as mentioned above with respect to the present invention. It is also desired to selectively use those having a low vapor pressure, less dangerness and low poison taking environmental pollution into consideration.

Taking the above points into consideration, usable solvents are required to have such properties as a high dielectric constant, low viscosity, low volatility maintaining the solvent in a liquid state at a room temperature. Typical organic solvents to be used are shown in Table 1.

TABLE 1

SOLVENTS TO BE USED AND THEIR PHYSICAL PROPERTIES

| STRUCTURES OF SOLVENTS | | RANGE OF TEMPERATURE (°C.) | DIELECTRIC CONSTANT | VISCOSITY (cp) |
|---|---|---|---|---|
| acetonitril | $CH_3-C\equiv N$ | −42 to 82 | 38 | 0.35 |
| dimethylformamide | 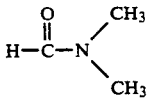 | −61 to 153 | 37 | |
| methanol | $CH_3-OH$ | −98 to 65 | 33 | |
| tetrahydrofrane | 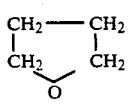 | −65 to 66 | 7.5 | 0.40 |

TABLE 1-continued

| SOLVENTS TO BE USED AND THEIR PHYSICAL PROPERTIES | | | | |
|---|---|---|---|---|
| STRUCTURES OF SOLVENTS | | RANGE OF TEMPERATURE (°C.) | DIELECTRIC CONSTANT | VISCOSITY (cp) |
| 1,2-dimethoxyethane | $CH_2-O-CH_3$<br>$\vert$<br>$CH_2-O-CH_3$ | −58 to 82 | 7.2 | 0.46 |
| γ-butyrolactone | 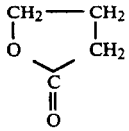 | −44 to 204 | 39 | 1.75 |

Water content of 3000 ppm according to the present invention (Claim 9)

In the same way, the water content is explained in a method for removing an outer oxidation factor in the organic electrolyte plating process.

Greatest care must be taken of water in the use of the organic solvent, since there are many polar organic solvents which can dissolve water so that there is an inevitable deficiency that they contain much water in the treatment process. The water is contained in the manufacturing process of the various organic solvents and is varied depending on the state of storage and use environment after manufacturing. Water absorption abilities are different from the solvent to solvent.

Especially, low molecule alcohols such as ethanol and methanol have an infinite solubility for water and have a high water absorption ability. There are also organic solvents having a high water absorption ability (a formamide etc.). The water content of the organic solvent itself is thus varied depending on the storage and use environment owing to the water absorption ability of the organic solvent.

Thus, the inventors of the present invention investigated the influence of the various conditions in the organic electrolyte plating and, as a result, they found to control the water content of the organic solvent and environment of plating process.

That is, according to the present invention, an organic electrolyte plating is carried out with the water content of the organic solvent being under 3000 ppm and an environment of the plating cell being $N_2$ or Ar isolated from the atmosphere. Thus, according to the present invention, various organic solvents can be used such as an alcohol including ethanol and methanol, an aromatic compound including benzen, an amide group, a BPC, a propylenecarbonate, a hexane or a xylene.

The reason why the water content is selected under 3000 ppm is that it is an upper limit for obtaining the plating cell which excels in the oxidation resistance and the brilliance.

With regard to the method for controlling the water content under 3000 ppm, the ordinary dehydration method using a Ca metal or a molecular sheave is used. Further with regard to the method for protecting the plating atmosphere, the electrolytic cell may be placed in an inert gas atmosphere such as Ar or $N_2$. It is especially desirable to place it in a globe box.

Contents of each component according to the present invention (Claim 8)

Metallic salts used in the present invention are able to form a good plating film by being contained in the organic solvent with the solubility of 0.1–2.0 mol/l varying the concentration in accordance with the purposes. The lower limit of metal addition should be 0.1 mol/l since, under the limit, productivity of the plating film and electric current efficiency are decreased by generation of a hydrogen which is a coexistence reaction, thereby necessitating a long plating time. The upper limit of metal addition should be 2.0 mol/l since, over the limit, uniform film can not be obtained by increase of a reaction rate and powders of metallic salts remained unreacted because of the solubility limitation of the metallic salts into the organic solvent inadversely influence the generating reaction of the plating film.

The supporting electrolyte and the stabilizer added to the organic solvent are either:

(1) a supporting electrolyte which is used in the electrolytic plating and the electrolysis for giving the electrolyte a conductivity or:

(2) a stabilizer or buffer for a plating cell. With either one or both of them together may be added to achieve the purpose of the present invention.

The supporting electrolyte and the stabilizer are enough for carrying out a desired plating if they are added to the organic solvent with the concentration of more than 0.005 mol/l. It is, however, necessary to add them at the concentration of more than 0.005 mol/l since it is not enough for the purposes of giving conductivity to the solvent or of stabilizing and buffering function under the range of under 0.005 mol/l.

As mentioned above, the present invention is greatly useful for industrial application since it provides an excellent plating film on the surface of a Nd-Fe-B rare earth permanent magnet which has a fine and uniform film organization and which is excellent in oxidation resistance, adhesion and brilliance of appearance.

BEST MODE OF CARRYING OUT THE INVENTION

Figure 1:
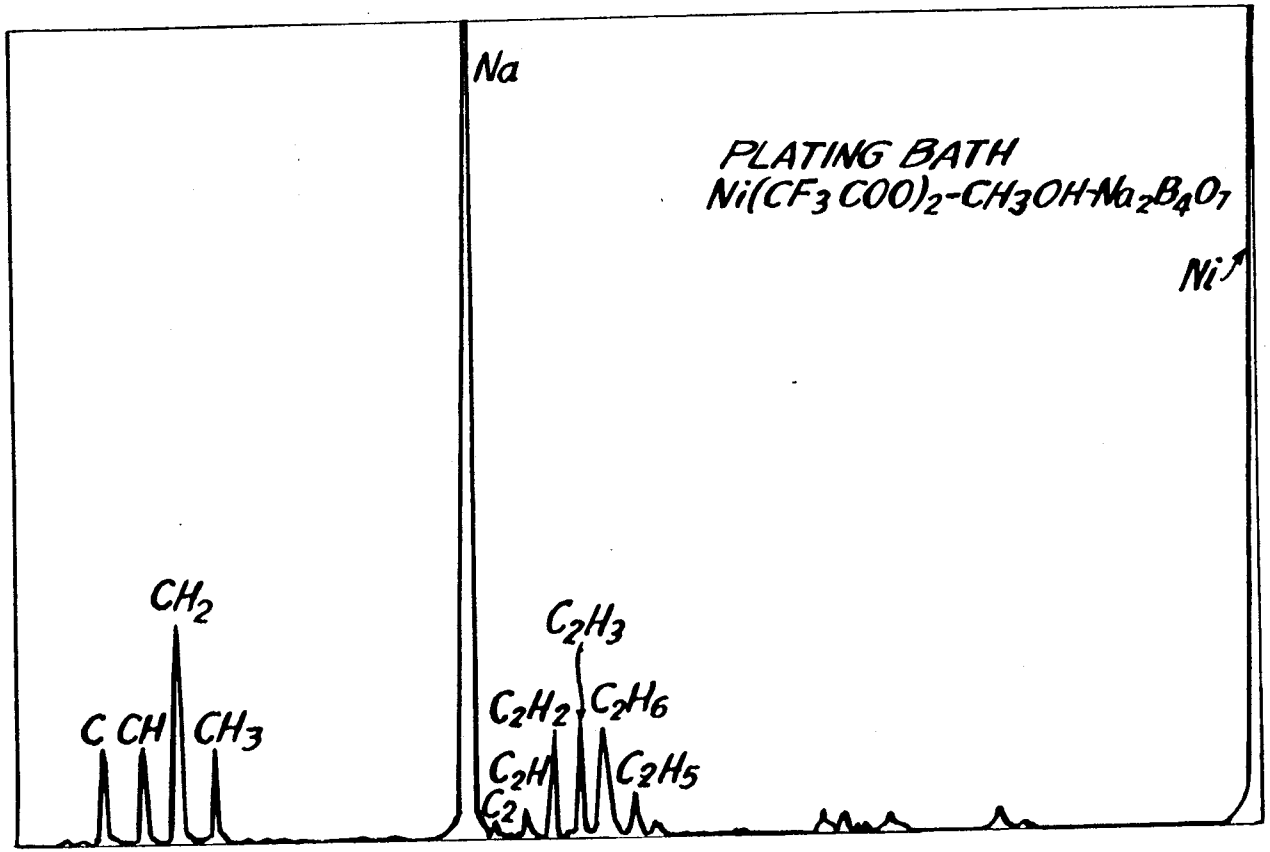
FIG. 1 is a diagram showing a result analysis of an organic electrolyte plating (Ni salt-$Na_2B_4O_7$-methanol)

Description is made below with respect to embodiments of the present invention referring to the drawings.

EXAMPLE 1

Samples for plating experiments are produced as described below.

At first, a sintered body consisting of 33 wt% Nd, 10 wt% B and the balance Fe was produced using an ordinary metallurgic method and then the sintered body was cut into pieces having a 10×10×5 (mm) size each forming a sample for a plating experiment.

Each of the above sample was subjected to organic electrolyte plating under the conditions of supporting electrolytes and electrolytic separation shown in Table 2 to produce another sample. Here, a methanol ($CH_3OH$) was used as a solvent consisting of a main component of the electrolyte and a trifluoroaceticnickel ($Ni(CF_3COO)_2$) was used as a metallic salt.

Comparison samples were produced using an ammoniumchloride ($NH_4Cl$), a lithiumnitrate ($LiNO_3$) and an ammonium hydrosulfide ($(NH_4)HSO_4$) as a supporting electrolyte.

TABLE 2

| | | Ni PLATING BY $Ni(CF_3COO)_2$ $CH_3OH$ BATH | | | |
|---|---|---|---|---|---|
| | | SUPPORTING ELECTROLYTE | | CURRENT | BATH |
| CLASS | SAMPLE | COMPOUND | CHEMICAL FORMULA | DENSITY ($A/cm^3$) | TEMPERATURE (°C.) |
| $R'_3BO_3$ | 1 | boracic acid | $H_3BO_3$ | 3 | 50 |
| | 2 | trimethyl borate | $(CH_3)_3BO_3$ | 1 | 40 |
| $MBO_2$ | 3 | metaboric acid | $HBO_2$ | 2 | 50 |
| | 4 | potassium metaborate | $KBO_2$ | 1 | 40 |
| $M'BO_3$ | 5 | potassium perborate | $KBO_3$ | 2 | 40 |
| | 6 | sodium perborate | $NaBO_3$ | 2 | 40 |
| $M'_2BxO$ | 7 | potassium tetraborate | $K_2B_4O_7$ | 2 | 40 |
| | 8 | sodium tetraborate | $Na_2B_4O_7$ | 2 | 30 |
| | 9 | sodium decaborate | $Na_2B_{10}O_{16}$ | 1 | 30 |
| $M'XO_4$ | 10 | sodium perchlorate | $NaClO_4$ | 1 | 40 |
| | 11 | lithium perchlorate | $LiClO_4$ | 2 | 40 |
| | 12 | sodium periodate | $NaIO_4$ | 1 | 40 |
| $R'_4NXO_4$ | 13 | ammonium perchlorate | $H_4NClO_4$ | 1 | 30 |
| | 14 | tetraethyl ammonium perchlorate | $(Et)_4NClO_4$ | 3 | 50 |
| | 15 | tetrabutyl ammonium perchlorate | $(Bu)_4NClO_4$ | 3 | 50 |
| $M'BX_4$ | 16 | lithium fluoborate | $LiBF_4$ | 3 | 40 |
| $R'_4NBX_4$ | 17 | tetrabutyl ammonium fluoborate | $(Bu)_4NBF_4$ | 4 | 40 |
| $M'PX_6$ | 18 | lithium hexafluorophosphate | $LiPF_6$ | 2 | 40 |
| $R'_4NPX_6$ | 19 | tetrabutyl ammonium tetrafluorophosphate | $(Bu)_4NPF_6$ | 3 | 50 |
| $M'CX_3SO_3$ | 20 | lithium trifluoromethane sulfonate | $LiCF_3SO_3$ | 1 | 40 |
| | 21 | tetramethyl ammonium trifluoromethane sulfonate | $(Bu)_4NCF_3SO_3$ | 4 | 40 |
| R'COOM' | 22 | potassium formate | HCOOK | 2 | 30 |
| | 23 | potassium acetate | $CH_3COOK$ | 3 | 40 |
| | 24 | sodium acetate | $CH_3COONa$ | 3 | 40 |
| More than | 25 | $H_3BO_3$:$(Bu)_4NClO_4$ = 5:5 | | 3 | 50 |
| two kinds | 26 | $(CH_3)BO_3$:$NaClO_4$ = 2:8 | | 1 | 40 |
| of | 27 | $KBO_2$:$H_4NClO_4$ = 6:4 = 6:4 | | 1 | 30 |
| support- | 28 | $Na_2B_4O_7$:$(Bu)_4NBF_4$ = 5:5 | | 3 | 40 |
| ing | 29 | $(Bu)_4NClO_4$:$CH_3COOK$ = 8:2 | | 3 | 50 |
| electro- | 30 | $H_3BO_3$:$(Bu)_4NCF_3SO_3$ = 5:5 | | 3 | 40 |
| lytes are | 31 | $H_3BO_3$:$(CH_3)_3BO_3$:$(Bu)_4NClO_4$ = 4:2:4 | | 3 | 50 |
| added | 32 | $K_2O_4O_7$:$LiBF_4$:$NaClO_4$ = 4:5:1 | | 2 | 40 |
| Compari- | 33 | ammonium chloride | $NH_4Cl$ | 3 | 40 |
| Son | 34 | lithium nitrate | $LiNO_3$ | 5 | 50 |
| Sample | 35 | ammonium hydrogen sulfate | $NH_4HSO_4$ | 3 | 40 |

Here, oxidation resistance tests were conducted for the samples (sample No. 1-35) which had been plated under the conditions of electrolytic separation shown in Table 2. The test method applied was a test under a low temperature of 60° C. and at constant humidity of 95% for 2000 hr. The results of the oxidation resistance tests are shown in Table 3.

TABLE 3

RESULTS OF OXIDATION RESISTANCE TEST FOR PLATED SAMPLES USING VARIOUS KINDS OF SUPPORTING ELECTROLYTES

| | TEST TIME (hr) SAMPLE No. | 50 | 100 | 300 | 500 | 1000 | 1500 | 2000 |
|---|---|---|---|---|---|---|---|---|
| INVENTION | 1 | | | | | | | |
| | 2 | | | | | | ○ | ○ |
| | 3 | | | | | | ○ | ○ |
| | 4 | | | | | | ○ | ○ |
| | 5 | | | | | | ○ | ○ |
| | 6 | | | | | | ○ | ○ |
| | 7 | | | | | | ○ | ○ |
| | 8 | | | | | | ○ | ○ |
| | 9 | | | | | ○ | ○ | ○ |
| | 10 | | | | ○ | ○ | ○ | Δ |
| | 11 | | | | | ○ | ○ | Δ |
| | 11 | | | | | | ○ | Δ |
| | 12 | | | | | | ○ | Δ |
| | 13 | | | | | | | ○ |
| | 14 | | | | | | | |
| | 15 | | | | | | | |
| | 16 | | | | | | ○ | ○ |
| | 17 | | | | | | | |
| | 18 | | | | | ○ | ○ | ○ |
| | 19 | | | | | | | ○ |
| | 20 | | | | | | ○ | ○ |
| | 21 | | | | | | | |
| | 22 | | | | ○ | ○ | Δ | x |
| | 23 | | | | ○ | ○ | Δ | Δ |
| | 24 | | | | | ○ | Δ | x |
| | 25 | | | | | | | |
| | 26 | | | | ○ | ○ | ○ | Δ |
| | 27 | | | | | ○ | ○ | ○ |
| | 28 | | | | ○ | ○ | ○ | ○ |
| | 29 | | | | ○ | ○ | Δ | Δ |
| | 30 | | | | | | | ○ |

TABLE 3-continued

RESULTS OF OXIDATION RESISTANCE TEST FOR PLATED SAMPLES USING VARIOUS KINDS OF SUPPORTING ELECTROLYTES

| TEST TIME (hr) SAMPLE No. | | 50 | 100 | 300 | 500 | 1000 | 1500 | 2000 |
|---|---|---|---|---|---|---|---|---|
| | 31 | | | | | | | |
| | 32 | | | | | ○ | ○ | ○ |
| COMPARISON | 33 | x | x | x | x | x | x | x |
| | 34 | x | x | x | x | x | x | x |
| | 35 | x | x | x | x | x | x | x |

Figure 2:
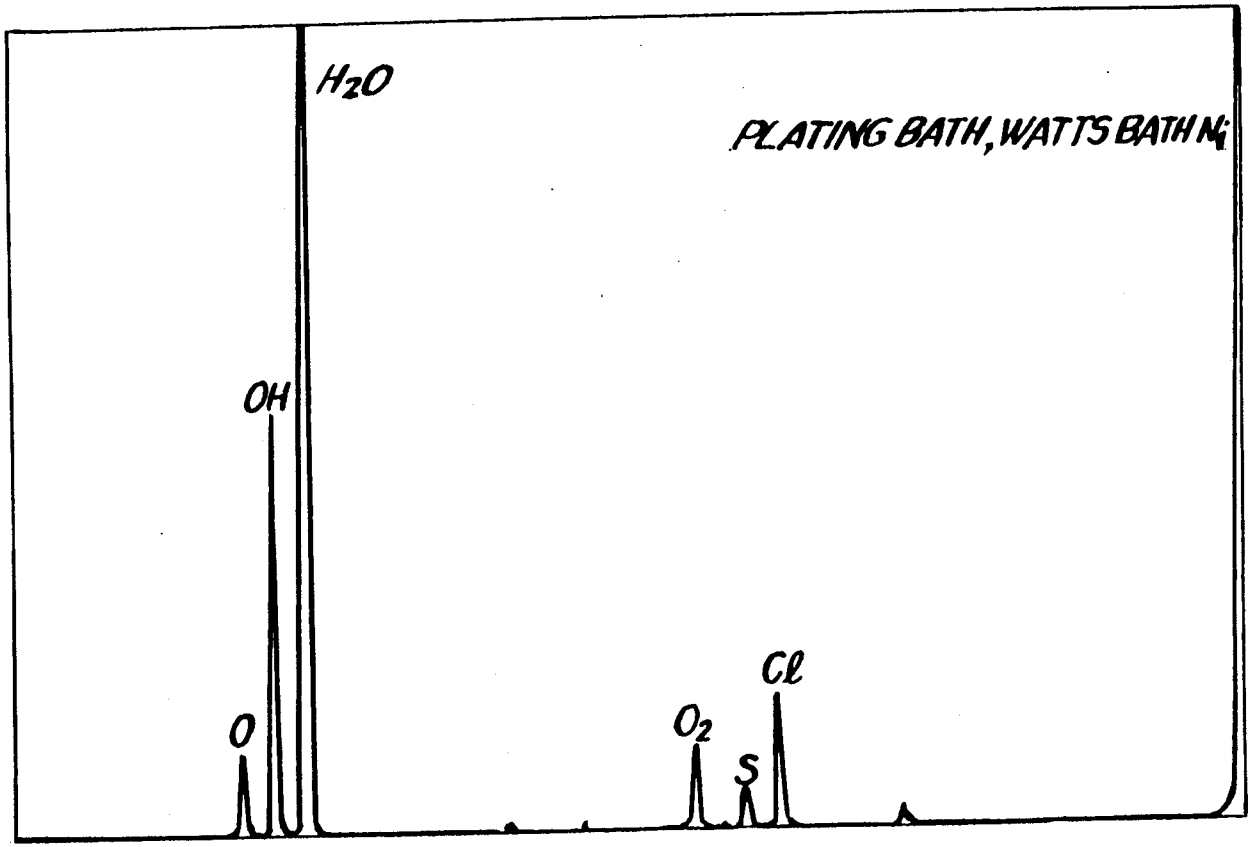
FIG. 2 is a graph showing a result of SIMS analysis of a plating sample made by a Watts bath.

Here,
. . . no change in the surface
○ . . . surface color changed
Δ . . . swell in the film
x . . . red rust precipitated For a comparison purpose between the organic plating according to Example 1 of the present invention and the plating according to the ordinary Watts bath, the analysis by SIMS method was performed with respect to the samples which is produced by plating the Nd-Fe-B sintered body used in the Example 1 with Ni using the Watts bath and to the samples which is produced by Ni-plating using the bath with a methanol-Ni salts-$Na_2B_4O_7$. of Example 1. The results of the analysis are shown in FIGS. 1 and 2. Here, FIG. 1 show the results with respect to the samples produced by the plating using the Watts bath and FIG. 2 shows the results with respect to the samples produced by the organic plating (Ni salts-$Na_2B_4O_7$-methanol).

It is understood from FIGS. 1 and 2 that there exist many substances such as $H_2O$ and $O_2$ which oxidize Nd-Fe-B in the plating using the Watts bath.

On the other hand, with respect to the plating according to the example of the present invention, although many peaks for a C-H compound are observed, no is observed, however, for $H_2O$ or $O_2$ which cause adverse influences. It is, therefore, clearly understood that impurities contained in the plating layers formed by an organic plating are quite different from those contained in the plating layers formed by using ordinary Watts bath.

EXAMPLE 2

A sintered body consisting of 33 wt% Nd, 1.0 B and the balance Fe was produced using an ordinary metallurgic method. The sintered body was cut into pieces having a 10×10×5 (mm) size and formed some T.R for a plating experiment.

Then, samples were produced by an organic electrolyte plating (a, b, c) according to the embodiments of the present invention under the plating conditions shown in Table 4. Samples for a comparison purpose were also produced by an organic electrolyte plating using a supporting electrolyte, $NH_4Cl$ (ammonium chloride), (Comparison 1) and by the Ni electrolytic plating using ordinary Watts bath (Comparison-1) under the plating conditions shown in Table 4.

TABLE 4

PLATING CONDITIONS FOR EACH SAMPLE

| SAMPLE No. | ORGANIC SOLVENT | SUPPORTING ELECTROLYTES | ORGANIC METAL | CURRENT DENSITY (A/dm²) | BATH TEMPERATURE (°C.) |
|---|---|---|---|---|---|
| 1 | methanol | $H_3BO_3$ | $Ni(CF_3COO)_2$ | 5 | 50 |
| 2 | formamide | $BO_3(CH_3)_3$ | " | 2 | 40 |
| 3 | methanol | $BO_3(CH_3)_3$:$H_3BO_3$ = 5:5 | " | 2 | 50 |
| comparison 1 | ethanol | $NH_4Cl$ | " | 3 | 40 |
| comparison 2 | Ni electrolytic plating with an ordinary Watt's bath | | | 4 | 40 |

These plated samples were subject to a 80° C., 95% humidity test for 500 hrs. The results of the oxidation resistance tests are shown in Table 5.

It is understood that the samples using supporting electrolytes according to the embodiments of the present invention are remarkably superior to the comparison samples in the oxidation resistance.

TABLE 5

THICKNESS OF PLATING FILMS FOR VARIOUS SUPPORTING ELECTROLYTES AND TEST RESULTS OF OXIDATION RESISTANCE

| SAMPLE NO. | AVERAGE FILM THICKNESS (μm) | TESTING HOURS (hr) 50 | 100 | 150 | 300 | 500 |
|---|---|---|---|---|---|---|
| a | 10 | | | | | ○ |
| b | 17 | | | ○ | ○ | Δ |
| c | 16 | | ○ | ○ | ○ | ○ |
| Comparison 1 | 10 | ○ | x | x | x | x |
| Comparison 2 | 15 | x | x | x | x | x |
| | | | | (80° C. × 95% RH) | | |

. . . No change
○ . . . Partial swell
Δ . . . Red rust observed
x . . . Red rust in whole surface and film exfoliation Although above description has been made with respect to Nd-Fe-B, it is readily understood that similar advantages are expected with respect to rare earth elements (R) including Y-T (transient metals)-B alloy.

EXAMPLE 3

A sintered body consisting of 33 wt% Nd, 1.0 B and the balance Fe was produced using an ordinary metallurgic method. The sintered body was cut into pieces having a 10×10×5 (mm) size and formed into samples for the plating experiment.

Then, samples were produced by an organic electrolyte plating under each plating condition added with a dicycle crown compound shown in Table 6. It is apparent from Table 6 that the dicycle crown compounds added are strongly located at Ni ions in the electrolyte thereby promoting dissociation of metallic salts and increasing the mobility of the ions. As a result, the same amount of electric current can be flown with a smaller electric voltage in the case the dicycle crown compounds are added compared to the electric voltage in the case the dicycle crown compounds are not added.

Although the dicycle crown compound which is easy to be located at Ni ions was selected in the above embodiment, it is, however, readily understood that similar advantages are expected by selecting dicycle crown compounds which are easy to be located at Ni ions when alkali metal ions are used as supporting electrolytes.

Then, the samples (No. 36–39) plated under the electrolytic separation condition shown in Table 6 were subject to oxidation resistance tests (a constant temperature of 60° C. and constant humidity of 95% for 2000 hrs).

The results of the oxidation resistance tests are shown in Table 7.

TABLE 6

PLATING CONDITION WITH CROWN COMPOUND

| SAMPLE No. | ORGANIC METAL | ORGANIC SOLVENTS | SUPPORTING ELECTROLYTES | CROWN COMPOUNDS | CURRENT DENSITY ($A/dm^3$) | BATH TEMPERATURE (°C.) | VOLTAGE (V) |
|---|---|---|---|---|---|---|---|
| 36 | $Ni(CH_3COO)_2$ | $CH_3OH$ | $Na_2B_4O_7$ | No Addition | 2 | 30 | 5.6 |
| 37 | " | " | " | 24 Krone8 | " | " | 4.2 |
| 38 | " | " | $LiCF_3SO_3$ | No Addition | 1 | 40 | 3.5 |
| 39 | " | " | " | 15-Krone5 | " | " | 2.8 |

TABLE 7

RESULT OF OXIDATION RESISTANCE TEST FOR PLATED SAMPLES

| RESULT (hr) SAMPLE NO. | 50 | 100 | 300 | 500 | 1000 | 1500 | 2000 |
|---|---|---|---|---|---|---|---|
| 36 | | | | | | ○ | ○ |
| 37 | | | | | | ○ | ○ |
| 38 | | | | | | ○ | ○ |
| 39 | | | | | | ○ | ○ |

Here,
represents "No change at surface"
○ represents "Color change at surface".

EXAMPLE 4

A sintered body consisting of 33 wt% Nd, 1.0 B and the balance Fe was produced using an ordinary metallurgic method. The sintered body was cut into pieces having a 10×10×5 (mm) size and formed some T.P for a plating experiment.

Then, the organic plating was applied to the samples using methanol-boraric acid trifluoroacetic nickel. The electrolysis conditions are a bath temperature of 40° C. and current density of 3 ($A/dm^2$). Here, 5 kinds of methanols were prepared and the water contents of which were previously adjusted to detect differences based on the water contents of the methanols. The water contents of the 5 kinds of methanols were measured using the Karl Fisher method and the results were 50 ppm, 280 ppm, 630 ppm, 620 ppm, 1450 ppm, 1540 ppm, 2860 ppm, 3510 ppm and 5780 ppm, respectively. Using these 7 kinds of methanols, the plating was applied under the plating conditions mentioned above.

Observation test of appearances and the test of a constant temperature of 80° C. and constant humidity of 95% was conducted for 500 hr.

The results are shown in Table 8. It is understood from Table 8 that the resultant plating films have excellent appearances and a good oxidation resistance with water content of the bath of under 3000 ppm.

TABLE 8

APPEARANCE AND OXIDATION RESISTANCE TEST RESULTS OF Ni PLATED Nd.Fe.B PERMANENT MAGNETS OBTAINED WITH THE WATER CONTENT OF METHANOL VARIED

| WATER CONTENT WITHIN METHANOL (ppm) | APPEARANCE OF PLATING FILMS | TESTING HOURS (hr) 50 | 100 | 150 | 300 | 500 |
|---|---|---|---|---|---|---|
| 50 | metallic brilliance of Ni | | → | → | → | → |
| 280 | metallic brilliance of Ni | | → | → | → | → |
| 620 | metallic brilliance of Ni | | → | → | → | → |
| 1540 | slightly gray metallic brilliance | | → | → | → | ○ |
| 2860 | slightly gray surface | ○ | → | → | Δ | Δ |
| 3510 | dark surface | x | → | → | → | → |
| 5780 | dark surface with slight exfoliation | x | → | → | → | → |

(80° C. × 95% R.H)

. . . No change
○ . . . Partial Swell
Δ . . . Red rust at edges
x . . . Red rust in whole surface or exfoliation of films

EXAMPLE 5

Samples consisting of 33 Nd, 1.0 B and the balance Fe (wt%) obtained in Example 4 were plated using methanol-boraric acid-trifluoroaceticnickel electrolyte in a bath open to the atmosphere in one hand, and in a bath placed in a globe box having a Ar atmosphere according to the present invention on the other hand thereby applying two kinds of plating.

Then, observation test of appearances and the 80° C. 95% constant temperature and humidity test of the samples was conducted for 1000 hr.

The results are shown in Table 9. It is understood from Table 9 that samples plated in the Ar atmosphere are superior in appearances and the oxidation resistance.

TABLE 9

APPEARANCES AND OXIDATION RESISTANCE TEST RESULT OF Nd.Fe.B PERMANENT MAGNETS PLATED WITH A BATH IN THE ATMOSPHERE AND A BATH IN THE Ar ATMOSPHERE

| BATH ATMOSPHERE | APPEARANCE OF PLATING FILM | TESTING HOURS (hr) 100 | 300 | 500 | 750 | 1000 |
|---|---|---|---|---|---|---|
| atmosphere | slightly gray and dim metallic brilliance | | | ○ | Δ | x |
| Ar | metallic brilliance with | | → | → | → | x |

TABLE 9-continued

| APPEARANCES AND OXIDATION RESISTANCE TEST RESULT OF Nd.Fe.B PERMANENT MAGNETS PLATED WITH A BATH IN THE ATMOSPHERE AND A BATH IN THE Ar ATMOSPHERE | | | | | | |
|---|---|---|---|---|---|---|
| BATH ATMOSPHERE | APPEARANCE OF PLATING FILM | TESTING HOURS (hr) | | | | |
| | | 100 | 300 | 500 | 750 | 1000 |
| a mirror surface of Ni | | (80° C. × 95% R.H) | | | | |

EXAMPLE 6

Samples for plating experiments are produced as described below.

A sintered body consisting of 33 wt% Nd, 1.0 wt% B and the balance Fe was produced using an ordinary metallurgic method and then the sintered body was cut into pieces having a 10×10×5 (mm) sizes each forming a sample for a plating experiment.

The above samples were subjected to organic electrolyte plating under the conditions shown in Table 10 to produce samples (Sample No. 40–63).

For a comparison purpose, samples (Sample No. 64, 65) were produced using Ni $(NO_3)_2$ as a metallic salt. Further, samples No. 66 and 67 were produced using a water solution electrolytic plating (Watts bath) and an Al ion plating respectively.

These samples (No. 40–67) being plated under the electrolytic separation conditions shown in Table 10 were subject to an oxidation resistance test. The test was conducted at 60° C. and constant humidity of 95% for 2000 hrs.

The results of the oxidation resistance tests are shown in Table 11. Here, the samples were subject to the test which were produced under the condition producing the most preferable plating film among the conditions shown in Table 10.

It is understood from Table 11 that samples No. 40–63 being plated with an organic electrolyte plating using metallic salts according to the present invention are superior in the oxidation resistance compared with comparison samples No. 64–67.

TABLE 10

| | SAMPLE NO. | COMPOSITION OF PLATING SOLUTION AND CONDITIONS OF ELECTROLYTIC SEPARATION | | | | |
|---|---|---|---|---|---|---|
| | | METALLIC SALTS | ORGANIC SOLVENTS | SUPPORTING ELECTROLYTES | CURRENT DENSITY (A/dm$^2$) | BATH TEMPERATURE (°C.) |
| Inventive | 40 | | | $H_3BO_3$ | 0.5–5 | 20–50 |
| | 41 | | | $Na_2B_4O_7$ | | |
| | 42 | $Ni(CF_3COO)_2$ | $CH_3OH$ | $NaClO_4$ | | |
| | 43 | | | $KBF_4$ | | |
| | 44 | | | $(Bu)_4NClO_4$ | | |
| | 45 | | | $H_3BO_3$:$(Bu)_4HClO_4$ = 1:1 | | |
| | 46 | | | $Na_2B_4O_7$:$(Bu)_4HClO_4$ = 1:1 | | |
| | 47 | | | $C_7H_5NO_3S$ | " | " |
| | 48 | $Ni(CF_3COO)_2$ | " | $HOSO_2NH_2$ | | |
| | 49 | | | $C_7H_5NO_3S$:$H_3BO_3$ = 1:1 | | |
| | 50 | | | — | " | " |
| | 51 | $Ni(ClO_4)_2$ | " | $H_3BO_3$ | | |
| | 52 | | | $Na_2B_4O_7$ | | |
| | 53 | | | $KBF_4$ | | |
| | 54 | $Ni(CF_3COO)_2$ + | " | $H_3BO_3$ | " | " |
| | 55 | $Ni(ClO_4)_2$ | | $H_3BO_3$:$KBF_4$ = 1:1 | | |
| | 56 | $Ni(CH_3COO)_2$ + | " | $C_7H_5NO_3S$ | " | " |
| | 57 | $Ni(ClO_4)_2$ | | $C_7H_5NO_3S$:$H_3BO_3$ = 1:1 | | |
| | 58 | $Al(CF_3COO)_2$ | " | $H_3BO_3$ | " | " |
| | 59 | | | $(Bu)_4HClO_4$ | | |
| | 60 | $Cu(CF_3COO)_2$ | " | $H_3BO_3$ | " | " |
| | 61 | | | $C_7H_5NO_3S$ | | |
| | 62 | $Zn(CH_3COO)_2$ | " | $H_3BO_3$ | " | " |
| | 63 | | | $(Bu)_4HClO_4$ | | |
| Comparison | 64 | $Ni(NO_3)_2$ | " | $H_3BO_3$ | " | " |
| | 65 | | | $(Bu)_4HClO_4$ | " | " |
| | 66 | Ni plating with water solution electrolyte using a Watts bath | | | 1–6 | 40–50 |
| | 67 | Al ion plating | | | | |

TABLE 11

| OXIDATION RESISTANCE TEST OF SAMPLES PLATED USING VARIOUS METALLIC SALTS | | | | | | | | |
|---|---|---|---|---|---|---|---|---|
| | | TESTING HOURS (hr) | | | | | | |
| SAMPLE | No. | 50 | 100 | 300 | 500 | 1000 | 1500 | 2000 |
| INVENTION | 40 | @ | @ | @ | @ | @ | @ | @ |
| | 41 | @ | @ | @ | @ | @ | ○ | ○ |
| | 42 | @ | @ | @ | @ | ○ | ○ | Δ |
| | 43 | @ | @ | @ | @ | @ | ○ | ○ |
| | 44 | @ | @ | @ | @ | @ | @ | @ |
| | 45 | @ | @ | @ | @ | @ | @ | @ |
| | 46 | @ | @ | @ | ○ | ○ | ○ | ○ |
| | 47 | @ | @ | @ | @ | @ | ○ | ○ |
| | 48 | @ | @ | @ | @ | ○ | ○ | Δ |
| | 49 | @ | @ | @ | @ | ○ | ○ | ○ |
| | 50 | @ | @ | @ | @ | @ | @ | ○ |
| | 51 | @ | @ | @ | @ | @ | @ | @ |
| | 52 | @ | @ | @ | @ | ○ | ○ | ○ |
| | 53 | @ | @ | @ | @ | @ | ○ | ○ |
| | 54 | @ | @ | @ | @ | @ | @ | @ |
| | 55 | @ | @ | @ | @ | @ | ○ | ○ |
| | 56 | @ | @ | @ | @ | @ | @ | ○ |
| | 57 | @ | @ | @ | @ | @ | ○ | ○ |
| | 58 | @ | @ | @ | @ | ○ | Δ | Δ |
| | 59 | @ | @ | @ | @ | ○ | ○ | Δ |
| | 60 | @ | @ | @ | ○ | ○ | Δ | x |
| | 61 | @ | @ | @ | ○ | ○ | ○ | Δ |
| | 62 | @ | @ | @ | @ | ○ | ○ | Δ |
| | 63 | @ | @ | @ | @ | @ | ○ | ○ |
| COM- | 64 | x | x | x | x | x | x | x |

TABLE 11-continued

| OXIDATION RESISTANCE TEST OF SAMPLES PLATED USING VARIOUS METALLIC SALTS | | | | | | | | |
|---|---|---|---|---|---|---|---|---|
| | | TESTING HOURS (hr) | | | | | | |
| SAMPLE | No. | 50 | 100 | 300 | 500 | 1000 | 1500 | 2000 |
| PARISON | 65 | Δ | x | x | x | x | x | x |
| | 66 | x | x | x | x | x | x | x |
| | 67 | @ | ∘ | ∘ | x | x | x | x |

@ No change
∘ Color change in the surface
Δ Swell of the film
x Red rust precipitated The reason why the result was obtained is probably that although nitrate series metallic salts heavily erode the surface of the Nd-Fe-B magnet preventing the electrolytic separation to occur there, acetate and perchlorate series metallic salts cause a very little influence to the magnets.

Although above description has been made with respect to Nd-Fe-B as one of the intermetallic compound permanent magnet, it is readily understood that similar advantages are expected with respect to rare earth elements (R) including Y-T (transient metals) - B alloy.

EXAMPLE 7

Samples for plating experiments are produced as described below. A sintered body consisting of 33 wt% Nd, 1.0 wt% B and the balance Fe was produced using an ordinary metallurgic method and then the sintered body was cut into pieces having a 10×10×5 (mm) size each forming a sample for a plating experiment.

The above samples were subjected to organic electrolyte plating with a plating solution having a composition and under the conditions shown in Table 12 and 13 to produce samples. Here, the bath temperature was selected to have its lower limit at a room temperature and its upper limit at a temperature slightly lower than the boiling temperature.

For a comparison purpose, samples were produced using an acetonitrile ($CH_3CN$), an ethylmethylketone ($CH_3COC_2H_5$) (which are hard to couple with metallic ions thereby not forming metallic complexes which are easy to be electrolytically separated) as an organic solvent. Further, samples 67 were produced using a water solution electrolytic plating (Watts bath) and an Al ion plating, respectively.

TABLE 12

| COMPOSITION OF PLATING SOLUTION AND CONDITIONS OF ELECTROLYTIC SEPARATION | | | | | |
|---|---|---|---|---|---|
| SAMPLE NO. | METALLIC SALTS | SUPPORTING ELECTROLYTES | ORGANIC SOLVENTS | CURRENT DENSITY ($A/dm^2$) | BATH TEMPERATURE (°C.) |
| 68 | $Ni(CF_3COO)_2$ | $H_3BO_3$ | $CH_3OH$ | | 20–50 |
| 69 | $Ni(CF_3COO)_2$ | $[CH_3(CH_2)_3]_4NClO_4$ | $CH_3OH$ | 0.5–5.0 | 20–50 |
| 70 | $Ni(CF_3COO)_2$ | $H_3BO_3$ | $C_2H_5OH$ | 0.5–5.0 | 20–70 |
| 71 | $Ni(CF_3COO)_2$ | $H_3BO_3$ | $CH_3CH(OH)CH_3$ | 0.5–5.0 | 20–80 |
| 72 | $Ni(CF_3COO)_2$ | $H_3BO_3$ | $C_4H_9OH$ | 0.5–5.0 | 20–110 |
| 73 | $Ni(CF_3COO)_2$ | $H_3BO_3$ | $HCON(CH_3)_2$ | 0.5–5.0 | 20–100 |
| 74 | $Ni(CF_3COO)_2$ | $H_3BO_3$ | $CH_3CONH_2$ | 0.5–5.0 | 20–160 |
| 75 | $Ni(CF_3COO)_2$ | $H_3BO_3$ | $HCONH_2$ | 0.5–5.0 | 20–140 |
| 76 | $Ni(CF_3COO)_2$ | $C_7H_5NO_3S$ | $CH_3OH$ | 0.5–5.0 | 20–50 |
| 77 | $Ni(CF_3COO)_2$ | $C_7H_5NO_3S$ | $HCON(CH_3)_2$ | 0.5–5.0 | 20–100 |
| 78 | $Ni(CF_3COO)_2$ | $NaH_2PO_2$ | $CH_3OH$ | 0.5–5.0 | 20–50 |
| 79 | $Ni(CF_3COO)_2$ | $NaH_2PO_2$ | $C_2H_5OH$ | 0.5–5.0 | 20–70 |
| 80 | $Ni(CF_3COO)_2$ | $NaH_2PO_2$ | $HCONH_2$ | 0.5–5.0 | 20–140 |
| 81 | $Ni(CF_3COO)_2$ Ni( | $H_3BO_3$ | $CH_3OH:HCONH_2$ = 8:2 | 0.5–5.0 | 20–50 |
| 82 | $Ni(CF_3COO)_2$ | $H_3BO_3$ | $HCON(CH_3)_2:HCONH_2$ = 6:4 | 0.5–5.0 | 20–100 |
| 83 | $Ni(CF_3COO)_2$ | $[CH_3(CH_2)_3]_4NClO_4$ | $C_2H_5OH:HCONH_2$ = 6:4 | 0.5–5.0 | 20–70 |

TABLE 13

| SAMPLE NO. | METALLIC SALTS | SUPPORTING ELECTROLYTES | ORGANIC SOLVENTS | CURRENT DENSITY ($A/dm^2$) | BATH TEMPERATURE (°C.) |
|---|---|---|---|---|---|
| 84 | $Ni(CH_3COO)_2$ | $C_7H_5NO_3S$ | $C_2H_5OH:HCONH_2$ = 6:4 | 0.5–5 | 20–70 |
| 85 | $Ni(CH_3COO)_2$ | $NaH_2PO_2$ | $CH_3OH:HCONH_2$ = 8:2 | 0.5–5 | 20–50 |
| 86 | $Ni(CF_3COO)_2$ | $[CH_3(CH_2)_3]_4NClO_4$ | $CH_3CN$ | 0.5–5 | 20–80 |
| 87 | $Ni(CF_3COO)_2$ | $H_3BO_3$ | $CH_3COC_2H_5$ | 0.5–5 | 20–70 |
| 88 | Ni plating with water solution electrolyte using a Watts bath | | | 0.5–5 | 20–70 |
| 89 | Al ion plating | | | 1–6 | 40–50 |

These samples (No. 68–89) being plated under the electrolytic separation conditions shown in Table 12 and 13 were subject to an oxidation resistance test. The test was conducted at a temperature of 60° C., and constant humidity of 95% for 2000 hrs. The results of the oxidation resistance tests are shown in Table 14. Here, the samples were subject to the test which were produced under the best condition producing the most preferable plating film among the conditions shown in Table 12 and 13.

TABLE 14

| OXIDATION RESISTANCE TEST OF SAMPLES PLATED USING VARIOUS ELECTROLYTE SOLVENTS | | | | | | | |
|---|---|---|---|---|---|---|---|
| | TEST HOURS (hr) | | | | | | |
| SAMPLE NO. | 50 | 100 | 300 | 500 | 1000 | 1500 | 2000 |
| 68 | | | | | | | |
| 69 | | | | | | | |
| 70 | | | | | | | |
| 71 | | | | | | | ∘ |

TABLE 14-continued

OXIDATION RESISTANCE TEST OF SAMPLES PLATED USING VARIOUS ELECTROLYTE SOLVENTS

| SAMPLE NO. | TEST HOURS (hr) 50 | 100 | 300 | 500 | 1000 | 1500 | 2000 |
|---|---|---|---|---|---|---|---|
| 72 | | | | | | ○ | ○ |
| 73 | | | | | | | ○ |
| 74 | | | | | | | ○ |
| 75 | | | | | | ○ | ○ |
| 76 | | | | | | ○ | ○ |
| 77 | | | | | | ○ | ○ |
| 78 | | | | | | | |
| 79 | | | | | | | |
| 80 | | | | | | | ○ |
| 81 | | | | | | | ○ |
| 82 | | | | | | ○ | ○ |
| 83 | | | | | | | ○ |
| 84 | | | | | | ○ | ○ |
| 85 | | | | | | | |
| 86 | | | ○ | Δ | x | x | x |
| 87 | | | ○ | x | x | x | x |
| 88 | x | x | x | x | x | x | x |
| 89 | | ○ | Δ | x | x | x | x |

Remarks:
No change
○ Color change in the surface
Δ Swell and exfoliation of film
x Red rust precipitated It is understood from Table 14 that samples being plated with an organic electrolyte plating using an organic solvent according to the present invention are superior in the oxidation resistance compared with comparison samples. Although above description has been made with respect to Nd-Fe-B as one of the intermetallic compound permanent magnet, it is readily understood that similar advantages are expected with respect to rare earth elements (R) including Y-T (transient metals) - B alloy.

EXAMPLE 8

Samples for plating experiments are produced as described below. A sintered body consisting of 33 wt% Nd, 1.0 wt% B and the balance Fe was produced using an ordinary metallurgic method and then the sintered body was cut into pieces having a 10×10×5 (mm) size each forming a sample for a plating experiment.

The above samples were subjected to organic electrolyte plating with a plating solution having a composition and under the conditions shown in Table 15 and 13 to produce samples.

For a comparison purpose, samples were produced using a water solution electrolytic plating (Watts bath) and an Al ion plating respectively.

TABLE 15

COMPOSITION OF PLATING SOLUTION AND CONDITIONS OF ELECTROLYTIC SEPARATION

| SAMPLE NO. | METALLIC SALT CHEMICAL FORMULA | AMOUNT | ADDITIVE CHEMICAL FORMULA | AMOUNT | ORGANIC SOLVENT | CURRENT DENSITY (A/dm$^2$) | BATH TEMPERATURE (°C.) |
|---|---|---|---|---|---|---|---|
| 90 | $Ni(CF_3COO)_2$ | 0.05 mol/l | $H_3BO_3$ | 0.5 mol/l | $CH_3OH$ | 0.5–5.0 | 20–50 |
| 91 | " | 0.1 mol/l | " | 0.5 mol/l | " | " | " |
| 92 | " | 0.5 mol/l | " | 0.5 mol/l | " | " | " |
| 93 | " | 0.5 mol/l | " | 0.5 mol/l | $C_2H_5OH$ | " | " |
| 94 | $Cu(CF_3COO)_2$ | 0.05 mol/l | $H_3BO_3$ | 0.5 mol/l | $CH_3OH$ | 0.5–5.0 | 20–50 |
| 95 | " | 0.1 mol/l | $H_3BO_3$ + $C_nH_5NO_3S$ | 0.5 mol/l | " | " | " |
| 96 | " | 0.5 mol/l | $H_3BO_3$ | 0.5 mol/l | " | " | " |
| 97 | $Ni(CF_3COO)_2$ + $Al(CF_3COO)_2$ | 0.05 mol/l | $H_3BO_3$ + $[CH_3(CH_2)_3]_4NClO_4$ | 0.4 mol/l | $CH_3OH$ | 0.5–5.0 | 20–50 |
| 98 | $Ni(CF_3COO)_2$ + $Al(CF_3COO)_2$ | 0.2 mol/l | $H_3BO_3$ + $[CH_3(CH_2)_3]_4NClO_4$ | 0.2 mol/l | $CH_3OH$ + $HCONH_2$ | " | " |
| 99 | $Ni(CF_3COO)_2$ + $Al(CF_3COO)_2$ | 0.7 mol/l | $H_3BO_3$ + $[CH_3(CH_2)_3]_4NClO_4$ | 0.4 mol/l | $CH_3OH$ | " | " |
| 100 | $Ni(ClO_4)_2$ | 0.05 mol/l | $H_3BO_3$ | 0.3 mol/l | $CH_3OH$ | 0.5–5.0 | 20–50 |
| 101 | " | 0.3 mol/l | " | 0.5 mol/l | " | " | " |
| 102 | " | 1.0 mol/l | " | 0.5 mol/l | " | " | " |
| 103 | $Ni(CH_3COO)_2$ | 0.05 mol/l | $NH_4Cl$ | 0.1 mol/l | $CH_3OH$ | 0.5–5.0 | 20–50 |
| 104 | " | 0.2 mol/l | " | 0.1 mol/l | " | " | " |
| 105 | " | 0.75 mol/l | " | 0.1 mol/l | " | " | " |
| 106 | " | 0.75 mol/l | " | 0.2 mol/l | " | " | " |
| 107 | " | 0.75 mol/l | " | 0.1 mol/l | $CH_3OH$ + $HCONH_2$ | " | " |
| 108 | $Ni(CF_3COO)_2$ | 0.05 mol/l | $NH_4Cl$ + $NaH_2PO_2$ | 0.1 mol/l 0.05 mol/l | $CH_3OH$ | 0.5–5.0 | 20–50 |
| 109 | " | 0.1 mol/l | $NH_4Cl$ + $NaH_2PO_2$ | 0.1 mol/l 0.05 mol/l | " | " | " |
| 110 | " | 0.75 mol/l | $NH_4Cl$ + $NaH_2PO_2$ | 0.1 mol/l 0.05 mol/l | " | " | " |
| 111 | " | 0.75 mol/l | $NH_4Cl$ + $NaH_2PO_2$ | 0.2 mol/l 0.1 mol/l | " | " | " |
| 112 | $Zn(CH_3COO)_2$ + $Ni(CH_3COO)_2$ | 0.05 mol/l | $NaH_2PO_2$ | 0.05 mol/l | $CH_3OH$ | 0.5–5.0 | 20–50 |
| 113 | $Zn(CH_3COO)_2$ + $Ni(CH_3COO)_2$ | 0.4 mol/l | " | 0.1 mol/l | " | " | " |
| 114 | $Zn(CH_3COO)_2$ + $Ni(CH_3COO)_2$ | 0.4 mol/l | " | 0.1 mol/l | $CH_3OH$ + $HCONH_2$ | " | " |
| 115 | $Zn(CH_3COO)_2$ + $Ni(CH_3COO)_2$ | 0.05 mol/l | $H_3BO_3$ + $[CH_3(CH_2)_3]_4NClO_4$ | 0.025 mol/l 0.025 mol/l | $CH_3OH$ | " | " |
| 116 | $Zn(CH_3COO)_2$ + $Ni(CH_3COO)_2$ | 0.1 mol/l | $H_3BO_3$ + $[CH_3(CH_2)_3]_4NClO_4$ | 0.5 mol/l 0.5 mol/l | $CH_3OH$ | " | " |
| 117 | $Zn(CH_3COO)_2$ + $Ni(CH_3COO)_2$ | 0.5 mol/l | $H_3BO_3$ + $[CH_3(CH_2)_3]_4NClO_4$ | 0.3 mol/l 0.2 mol/l | $CH_3OH$ | " | " |
| 118 | $Zn(CH_3COO)_2$ + | 0.5 mol/l | $H_3BO_3$ + | 0.3 mol/l | $CH_3OH$ + | 1.0–6.0 | 40–50 |

TABLE 15-continued

| SAMPLE NO. | COMPOSITION OF PLATING SOLUTION AND CONDITIONS OF ELECTROLYTIC SEPARATION | | | | | | |
|---|---|---|---|---|---|---|---|
| | METALLIC SALT | | ADDITIVE | | | | |
| | CHEMICAL FORMULA | AMOUNT | CHEMICAL FORMULA | AMOUNT | ORGANIC SOLVENT | CURRENT DENSITY ($A/dm^2$) | BATH TEMPERATURE (°C.) |
| | $Ni(CH_3COO)_2$ | | $[CH_3(CH_2)_3]_4NClO_4$ | 0.2 mol/l | $HCONH_2$ | | |
| 119 | Ni plating with water solution electrolyte using a Watts bath | | | | | | |
| 120 | Al ion plating | | | | | | |

These samples (No. 90–120) being plated under the electrolytic separation conditions shown in Table 15 were subject to an oxidation resistance test. The test was conducted at a temperature of 60° C., and a constant humidity of 95% for 2000 hrs. The results of the oxidation resistance tests are shown in Table 16.

Here, the samples were subject to the test which were produced under the best condition producing the most preferable plating film among the conditions shown in Table 15.

TABLE 16

OXIDATION RESISTANCE TEST OF SAMPLES PLATED USING VARIOUS PLATING SOLUTION

| SAMPLE NO. | TEST HOURS (hr) | | | | | | |
|---|---|---|---|---|---|---|---|
| | 50 | 100 | 300 | 500 | 1000 | 1500 | 2000 |
| 90 | @ | @ | @ | @ | ○ | ○ | Δ |
| 91 | @ | @ | @ | @ | @ | @ | ○ |
| 92 | @ | @ | @ | @ | @ | @ | @ |
| 93 | @ | @ | @ | @ | @ | @ | @ |
| 94 | @ | @ | @ | ○ | Δ | x | x |
| 95 | @ | @ | @ | ○ | ○ | Δ | x |
| 96 | @ | @ | @ | ○ | ○ | Δ | x |
| 97 | @ | @ | @ | ○ | Δ | Δ | x |
| 98 | @ | @ | @ | @ | ○ | ○ | Δ |
| 99 | @ | @ | @ | @ | @ | ○ | ○ |
| 100 | @ | @ | @ | @ | @ | ○ | ○ |
| 101 | @ | @ | @ | @ | @ | @ | @ |
| 102 | @ | @ | @ | @ | @ | @ | @ |
| 103 | @ | @ | @ | @ | ○ | ○ | Δ |
| 104 | @ | @ | @ | @ | @ | ○ | ○ |
| 105 | @ | @ | @ | @ | @ | @ | @ |
| 106 | @ | @ | @ | @ | @ | @ | @ |
| 107 | @ | @ | @ | @ | @ | @ | ○ |
| 108 | @ | @ | @ | @ | ○ | ○ | Δ |
| 109 | @ | @ | @ | @ | @ | ○ | ○ |
| 110 | @ | @ | @ | @ | @ | @ | @ |
| 111 | @ | @ | @ | @ | @ | @ | @ |
| 112 | @ | @ | @ | @ | ○ | ○ | Δ |
| 113 | @ | @ | @ | @ | @ | @ | ○ |
| 114 | @ | @ | @ | @ | @ | ○ | ○ |
| 115 | @ | @ | @ | @ | @ | @ | @ |
| 116 | @ | @ | @ | @ | ○ | ○ | ○ |
| 117 | @ | @ | @ | @ | @ | ○ | ○ |
| 118 | @ | @ | @ | @ | @ | ○ | ○ |
| 119 | x | x | x | x | x | x | x |
| 120 | @ | ○ | Δ | x | x | x | x |

In the Table:
@No change
○ Color change in the surface
Δ Swell and exfoliation of film
x Red rust precipitated It is understood from Table 16 that samples being plated with an organic electrolyte plating using an organic solvent according to the present invention are superior in the oxidation resistance compared with comparison samples. Further, it is understood that the advantage is more superior in the metallic salt density range of more than 0.1 mol/l.

INDUSTRIAL APPLICABILITY

According to the present invention described above, a plating film can be formed on the surface of a Nd-Fe-B magnet which has remarkably high oxidation resistance, high adhesion and a beautiful appearance of metallic brilliance by using a supporting electrolyte according to the present invention in an organic electrolyte plating which is very useful in the industrial applications. Further, using a crown compound according to the present invention in an organic electrolyte plating, it forms complexes with electrolytically dissociated ions thereby increasing solubility into the organic solvent and increasing conductivity of the supporting electrolyte according to the present invention by cooperative function.

According to the present invention, further, it is possible to prevent water or oxygen from entering from the atmosphere thereby remarkably decreasing the water or coexisting oxygen which adversely influence the plating process by controlling the amount of the water remaining in the organic solvent for the electrolyte to be under 3000 ppm and by placing the plating bath in an inert gas atmosphere such as Ar or $N_2$.

According to the present invention, further, it is possible to form a plating film on the surface of a Nd-Fe-B magnet which has high oxidation resistance, high adhesion and an excellent appearance and it is also possible to obtain a Nd-Fe-B intermetallic compound permanent magnet having high oxidation resistance by using as metallic salts at least one of a trifluoroacetate of a transition metal (including Al, Sn, Pb, Cr, Ni, Cu and Zn), an acetate, perchlorate.

According to the present invention, further, it is possible to form a plating film on the surface of a Nd-Fe-B magnet which has high oxidation resistance, high adhesion and an excellent appearance and it is also possible to obtain a Nd-Fe-B intermetallic compound permanent magnet having high oxidation resistance by using an organic electrolyte solution consisting of the 0.1–2 0 mol/l metallic salts, more than 0.005 mol/l additive (a supporting electrolyte and a stabilizer), and the balance of the organic solvent.

Here, although the description has been made with respect to Nd-Fe-B series magnets as one of the intermetallic rare earth permanent magnets, it is readily understood that a similar advantage will be expected with respect to R (rare earth elements including Y) - T(transition metals) - B series alloy.

We claim:

1. An organic solvent electrolyte for forming a plating film on the surface of a $R_2R_{14}B$ intermetallic compound permanent magnet which is used in a plating process based on a plating method using organic solvent electrolyte comprising a metallic salt including at least one metallic element, a supporting electrolyte and the balance of an organic solvent for forming a plating film on the surface of a $R_2T_{14}B$ intermetallic compound permanent magnet (herein, R denotes a rare earth element including Y and T denotes a transition metal)

including R, Fe and B as main components, characterized in that said supporting electrolyte includes at least one selected from a group consisting of:

(1) a boric acid compound including at least one of $R'_3BO_3$ (R' denotes H or methyl, ethyl, propyl group), $MBO_2$ (m denotes H or alkaline metal), $M'BO_3$ (M' denotes H or an alkaline metal selected from the group Na, K and Li), $M'_2B_xO_{(3x+2)/2}$ (x is an even number of more than 2), (2) a $C10_4$ salt of an alkaline metal or tetraalkylammonium including at least one of $M'C10_4$ or $R'_4NC10_4$, (3) a $BF_4^-$ salt of an alkali metal or tetraalkylammonium including at least one of $M'BF_4$ or $R'NBF_4$ (4) a $PF_6$ salt of an alkali metal or tetraalkylammonium including at least one of $M'PF_6$ or $R'NPF_6$, (5) a $CF_3SO_3^-$ salt of an alkali metal or tetraalkylammonium including at least one of $M'CF_3SO_3$ or $R'_4NCF_3SO_3$, (6) a $R'COO^-$ salt of an alkali metal including R'COOM.

2. An organic solvent electrolyte for plating a $R_2T_{14}B$ intermetallic compound permanent magnet as claimed in claim 1, characterized n that said tetraalkylammonium $C10_4$ salt is a perchloric acid tetrabutyrammonium $CH_3(CH_2)3)_4NC10_4$.

3. An organic solvent electrolyte for plating a $R_2T_{14}B$ intermetallic compound permanent magnet as claimed in claim 1, characterized in that said organic solvent electrolyte includes dycyclic crown compound added with said supporting electrolyte thereby forming anionic complex therein to activate metallic cation.

4. An organic solvent electrolyte for plating which is used in a plating process based on a plating method using organic solvent electrolyte comprising a metallic salt including at least one metallic element, a supporting electrolyte and the balance of an organic solvent for forming a plating film on the surface of a $R_2T_{14}B$ intermetallic compound permanent magnet (herein, R denotes a rare earth element including Y and T denotes a transition metal) including R, Fe and B as main components, and is characterized in that said supporting electrolyte includes at least one of a trifluoroacetate, an acetic acid and a perchlorate as the metallic salt and at least one element of Al, Pb, Sn, Cr, Ni, Cu and Zn as the acids.

5. An organic solvent electrolyte for plating which is used in a plating process based on a plating method using organic solvent electrolyte comprising a metallic salt including at least one metallic element, a supporting electrolyte and the balance of an organic solvent for forming a plating film on the surface of a $R_2T_{14}B$ intermetallic compound permanent magnet (herein, R denotes a rare earth element including Y and T denotes a transition metal) including R, Fe and B as a main components, and is characterized in that said organic solvent includes at least one of a protic ampthoteric solvent and a protophilic solvent.

6. An organic solvent electrolyte for plating a $R_2T_{14}B$ intermetallic compound permanent magnet as claimed in claim 5, characterized in that said protic ampthoteric solvent in the organic solvent electrolyte includes at least one of methanol ($CH_3OH$) and ethanol ($C_2H_5OH$) and the protophilic solvent includes at least one of a holmamide ($HCONH_2$), dimethylholmamide $HCON(CH_3)_2$ and acetamide ($CH_3CONH_2$).

7. An organic solvent electrolyte for plating a $R_2T_{14}B$ intermetallic compound permanent magnet as claimed in claim 1, characterized in that said organic solvent electrolyte includes at least one of a hypophosphite $MH_2PO_2$ and sulfamic acid ($C_7H_5NO_3S$) as a stabilizer added with said supporting electrolyte.

8. An organic solvent electrolyte for plating a $R_2T_{14}B$ intermetallic compound permanent magnet as claimed in claim 1, characterized in that said organic solvent electrolyte substantially includes said metallic salt of 0.1-2.0 mol/l, said supporting electrolyte and said stabilizer of at least 0.005 mol/l and the balance of said solvent.

9. An organic solvent electrolyte for plating a $R_2T_{14}$ B intermetallic compound permanent magnet as claimed in either one of claims 1-8 and 10-29, characterized in that either one of said organic solvent electrolyte includes water of substantially less than 3000 ppm.

10. An organic solvent electrolyte for plating a $R_2T_{14}B$ intermetallic compound permanent magnet as claimed in claim 2, characterized in that either one of said organic solvent electrolyte includes dycyclic crown compound added with said supporting electrolyte thereby forming an anionic complex therein to activate metallic cation.

11. An organic solvent electrolyte for plating a $R_2T_{14}B$ intermetallic compound permanent magnet as claimed in claim 2, characterized in that said organic solvent electrolyte includes at least one of a hypophosphite $MH_2PO_2$ and sulfamic acid ($C_7H_5NO_3S$) as a stabilizer added with said supporting electrolyte.

12. An organic solvent electrolyte for plating a $R_2T_{14}B$ intermetallic compound permanent magnet as claimed ni claim 3, characterized in that said organic solvent electrolyte includes at least one of a hypophosphite $MH_2PO_2$ and sulfamic acid ($C_7H_5NO_3S$) as a stabilizer added with said supporting electrolyte.

13. An organic solvent electrolyte for plating a $R_2T_{14}B$ intermetallic compound permanent magnet as claimed in claim 4, characterized in that said organic solvent electrolyte includes at least one of a hypophosphite $MH_2PO_2$and sulfamic acid ($C_7H_5NO_3S$) as a stabilizer added with said supporting electrolyte.

14. An organic solvent electrolyte for plating a $R_2T_{14}B$ intermetallic compound permanent magnet as claimed in claim 5, characterized in that said organic solvent electrolyte includes at least one of a hypophosphite $MH_2PO_2$ and sulfamic acid ($C_7H_5NO_3S$) as a stabilizer added with said supporting electrolyte.

15. An organic solvent electrolyte for plating a $R_2T_{14}B$ intermetallic compound permanent magnet as claimed in claim 6, characterized in that said organic solvent electrolyte includes at least one of a hypophosphite $MH_2PO_2$ and sulfamic acid ($C_7H_5NO_3S$) as a stabilizer added with said supporting electrolyte.

16. An organic solvent electrolyte for plating a $R_2T_{14}B$ intermetallic compound permanent magnet as claimed in claim 10, characterized in that said organic solvent electrolyte includes at least one of a hypophosphite $MH_2PO_2$ and sulfamic acid ($C_7H_5NO_3S$) as a stabilizer added with said supporting electrolyte.

17. An organic solvent electrolyte for plating a $R_2T_{14}B$ intermetallic compound permanent magnet as claimed in claim 2, characterized in that said organic solvent electrolyte substantially includes said metallic salt of 0.1-2.0 mol/l, said supporting electrolyte and said stabilizer of at least 0.005 mol/l and the balance of said solvent.

18. An organic solvent electrolyte for plating a $R_2T_{14}B$ intermetallic compound permanent magnet as claimed in claim 3, characterized in that said organic solvent electrolyte substantially includes said metallic salt of 0.1–2.0 mol/l, said supporting electrolyte and said stabilizer of at least 0.005 mol/l and the balance of said solvent.

19. An organic solvent electrolyte for plating a $R_2T_{14}B$ intermetallic compound permanent magnet as claimed in claim 4, characterized in that said organic solvent electrolyte substantially includes said metallic salt of 0.1–2.0 mol/l, said supporting electrolyte and said stabilizer of at least 0.005 mol/l and the balance of said solvent.

20. An organic solvent electrolyte for plating a $R_2T_{14}B$ intermetallic compound permanent magnet as claimed in claim 5, characterized in that said organic solvent electrolyte substantially includes said metallic salt of 0.1–2.0 mol/l, said supporting electrolyte and said stabilizer of at least 0.005 mol/l and the balance of said solvent.

21. An organic solvent electrolyte for plating a $R_2T_{14}B$ intermetallic compound permanent magnet as claimed in claim 6, characterized in that said organic solvent electrolyte substantially includes said metallic salt of 0.1–2.0 mol/l, said supporting electrolyte and said stabilizer of at least 0.005 mol/l and the balance of said solvent.

22. An organic solvent electrolyte for plating a $R_2T_{14}B$ intermetallic compound permanent magnet as claimed in claim 7, characterized in that said organic solvent electrolyte substantially includes said metallic salt of 0.1–2.0 mol/l, said supporting electrolyte and said stabilizer of at least 0.005 mol/l and the balance of said solvent.

23. An organic solvent electrolyte for plating a $R_2T_{14}B$ intermetallic compound permanent magnet as claimed in claim 10, characterized in that said organic solvent electrolyte substantially includes said metallic salt of 0.1–2.0 mol/l, said supporting electrolyte and said stabilizer of at least 0.005 mol/l and the balance of said solvent.

24. An organic solvent electrolyte for plating a $R_2T_{14}B$ intermetallic compound permanent magnet as claimed in claim 11, characterized in that said organic solvent electrolyte substantially includes said metallic salt of 0.1–2.0 mol/l, said supporting electrolyte and said stabilizer of at least 0.005 mol/l and the balance of said solvent.

25. An organic solvent electrolyte for plating a $R_2T_{14}B$ intermetallic compound permanent magnet as claimed in claim 12, characterized in that said organic solvent electrolyte substantially includes said metallic salt of 0.1–2.0 mol/l, said supporting electrolyte and said stabilizer of at least 0.005 mol/l and the balance of said solvent.

26. An organic solvent electrolyte for plating a $R_2T_{14}B$ intermetallic compound permanent magnet as claimed in claim 13, characterized in that said organic solvent electrolyte substantially includes said metallic salt of 0.1–2.0 mol/l, said supporting electrolyte and said stabilizer of at least 0.005 mol/l and the balance of said solvent.

27. An organic solvent electrolyte for plating a $R_2T_{14}B$ intermetallic compound permanent magnet as claimed in claim 14, characterized in that said organic solvent electrolyte substantially includes said metallic salt of 0.1–2.0 mol/l, said supporting electrolyte and said stabilizer of at least 0.005 mol/l and the balance of said solvent.

28. An organic solvent electrolyte for plating a $R_2T_{14}B$ intermetallic compound permanent magnet as claimed in claim 15, characterized in that said organic solvent electrolyte substantially includes said metallic salt of 0.1–2.0 mol/l, said supporting electrolyte and said stabilizer of at least 0.005 mol/l and the balance of said solvent.

29. An organic solvent electrolyte for plating a $R_2T_{14}B$ intermetallic compound permanent magnet as claimed in claim 16, characterized in that said organic solvent electrolyte substantially includes said metallic salt of 0.1–2.0 mol/l, said supporting electrolyte and said stabilizer of at least 0.005 mol/l and the balance of said solvent.

* * * * *